US005176408A

United States Patent [19]

Pedersen

[11] Patent Number: 5,176,408

[45] Date of Patent: Jan. 5, 1993

[54] SEAL DEVICE FOR PIPES PASSING THROUGH ROOF STRUCTURES

[76] Inventor: Raymond J. Pedersen, 12 Fallons Way, Bayswater, Victoria 3153, Australia

[21] Appl. No.: 632,617

[22] Filed: Dec. 26, 1990

Related U.S. Application Data

[63] Continuation of Ser. No. 328,223, Feb. 27, 1989, abandoned.

[30] Foreign Application Priority Data

Jun. 4, 1987 [AU] Australia ..... PI2345

[51] Int. Cl.[5] ..... F16L 5/00

[52] U.S. Cl. ..... 285/42; 285/43; 285/44; 285/419

[58] Field of Search ..... 285/42, 43, 44, 419; 24/136 R

[56] References Cited

U.S. PATENT DOCUMENTS

| | | | |
|---|---|---|---|
| 1,031,577 | 7/1912 | Overton | 285/44 |
| 1,213,022 | 1/1917 | Rossi | 285/44 |
| 2,985,465 | 5/1961 | Church | 285/42 |
| 3,098,663 | 7/1963 | Dibley | 285/43 |
| 3,871,145 | 3/1975 | Hatmaker | 285/42 X |
| 4,211,423 | 7/1980 | Resech | 285/42 X |
| 4,664,390 | 5/1987 | Houseman | 285/42 X |

FOREIGN PATENT DOCUMENTS

| | | |
|---|---|---|
| 0023418 | 2/1981 | European Pat. Off. . |
| 1499592 | 10/1967 | France . |
| 2332116 | 6/1977 | France . |
| 0003323 | 6/1987 | PCT Int'l Appl. . |

*Primary Examiner*—Randolph A. Reese
*Assistant Examiner*—Timothy Aberle
*Attorney, Agent, or Firm*—Ribis, Graham & Curtin

[57] ABSTRACT

A seal device for providing a weather seal between an elongated member such as a pipe, and a surface, such as a roof of a building, through which the pipe extends. The seal device has an apertured base member of resilient material with one end in contact with the roof and the opposite end with an aperture through which the pipe extends. The base member has a sleeve of resilient material integral and projecting from one surface thereof and includes the aperture on the opposite end of the sleeve. A rib formed integral with the sleeve and base member projecting outwardly from the external surface thereof. The rib extends generally down the length of the sleeve and across the base member whereby in use the wall of the sleeve and base member may be slit adjacent to and for the full length of the rib to permit opening of the sleeve and base member to allow fitting around the pipe. The rib has clamp means for holding it closed.

21 Claims, 4 Drawing Sheets

SEAL DEVICE FOR PIPES PASSING THROUGH ROOF STRUCTURES

This application is a continuation of application Ser. No. 328,223, filed Feb. 27, 1989, now abandoned.

This invention relates to an improved seal device for providing a weather seal between an elongate member and a non-planar surface, such as a roof or wall of a building of like structure.

There are currently in use in Australia seal devices for this purpose comprising an apertured base member including a non-metallic apertured flange element of resilient material bonded in face-to-face relation to a peripheral or part peripheral manually deformable non-resilient metallic flange, and a sleeve member of resilient material integral with the base member and extending upwardly therefrom to receive the elongate member. The base member is in use secured to the non-planar roof or wall and, being of a non-resilient manually deformable nature may, in use, be deformed to conform to the contour of the non-planar surface and will substantially retain such deformed contour. The sleeve member has an end remote from the base member which is adapted to receive said elongate member in sealing engagement therewith when the seal device is in use. The sleeve member, between the said remote end thereof and the base member, is preferably sufficiently flexible to accommodate in use misalignment between the base member and the remote end of the sleeve, that may arise during installation or during the service life of the seal device.

One form of a seal device of the general construction as above referred to is described in more detail in U.S. Pat. No. 4,333,660 issued to Cupit in June 1982. That seal device is very effective when used for pipes or ducts of a size up to about 400 mm diameter or similarly sized rectangular ducts. However, in many applications, as encountered in industrial and commercial building, it is required to seal about large pipes and ducts, as used in ventilation and air conditioning systems, and a modification of the seal device, above referred to, for use on large pipes is disclosed in U.S. Pat. No. 4,664,390 issued May 12, 1987 to David G. Houseman.

Both of the above referred to known constructions require the seal device to be assembled to the elongated member by inserting one end of the member through the sleeve member of the seal device, and then passing the seal device along the elongated member until it comes into the required location relative to the roof or wall structure. This mode of assembly requires the absence of the components on the elongated member or parts thereof protruding beyond the outside surface of the elongate member, which would interfere with the movement of the sleeve of the seal device along the elongate member.

During the initial construction, it is normally possible to arrange the fitment of the seal device to the elongate member before other components, which would interfere with the fitment of the seal device, are attached thereto. However, in situations where it is not possible to insert the end of the elongate member through the sleeve and move the seal device into its required position, seal devices of the above discussed construction cannot be employed. Also it is frequently necessary to provide a replacement seal about an elongate member which is coupled to equipment or has a weather cover or structural stays attached thereto, which preclude the sliding of the sleeve portion of the seal device along the elongate member.

It is therefore the principal object of the present invention to provide an effective weather seal device for use on elongate members that extend through roofs or like surfaces, that is capable of being installed whilst the elongate member is in situ extending through the structure, and irrespective of other components or equipment which may be coupled to or mounted on the elongated member.

With this object in view, there is provided by the present invention a seal device for providing a weather seal between an elongate member and a surface through which the elongate member extends, such as a roof or wall of a building or like structure, the seal device comprising an apertured base member of resilient deformable material to be located in use in superimposed relation to the surface with the elongate member extending through the aperture, a sleeve of resilient deformable material integral with the base member and projecting from one side thereof, the sleeve member encompassing said aperture in the base member so that in use the elongate member also extends through the sleeve member, a rib formed integral with the sleeve and base members projecting outwardly from the external surface thereof, said rib extending generally down the length of the sleeve member and across the base member, whereby in use the sleeve and base member may be slit adjacent to and for the full length of the rib to permit opening of the sleeve member and base member for fitment about the elongate member, and clamp means secured to the sleeve member and base member and extending parallel to and for the length of the rib so the slit may be made between the rib and the clamp means, the clamp means being adapted to embrace the rib and be non resiliently deformed to grip the rib and sealably close the slit to secure the sleeve and base member around the elongate member, the sleeve member, when in use having at the end remote from the base member an aperture dimensioned to receive the elongate member in sealing engagement.

Conveniently, the clamp means comprises a number of clamp elements located in side by side relationship along the length of and adjacent the rib, whereby the closing of the slit and the clamping of the sleeve and base members by the clamp means to sealably close the slit, can be achieved, notwithstanding that the rib may follow a non-linear, curved or tortuous path after fitment of the seal device to the elongate member. The clamp means may comprise a series of clips, preferably secured together in a strip-like manner with the connection between adjacent clips sufficiently flexible or pliable so that each clip may embrace and grip the rib to form a sealed closure even though the rib may follow a non-linear path.

Preferably the rib is provided with a shoulder along the side remote from the clamp means, and the clips may be adapted to interengage with the shoulders when embracing and gripping the rib, thereby increasing the strength of the grip and seal between the clamp means and the rib. The clamp means may be in the form of a plurality of generally U-shaped clips with the clips joined one to the other along the base of the U to provide the required degree of flexibility of the strip to follow the non-linear contour of the rib. The clips having extended fingers along one side of the clamp means, the fingers being attached to the sleeve and/or base member such as by being embedded in or bonded to or into the sleeve and/or base member.

The seal device constructed in the above manner is suitable for use in the conventional way by inserting the end of the elongated member through the sleeve member and thereafter sliding the seal device along the elongated member to take up the required position. However, the seal device in accordance with the present invention has the additional capability of being fitted to an elongated member, in situ projecting through a roof or like surface, without having to be threaded onto the elongated member from an end thereof. This is achieved by the operator splitting the sleeve and base member along beside the rib, or along a groove provided adjacent to, or in the rib. The operator may then open the seal device and place it about the elongated member so that the latter extends through the sleeve member. Thereafter the operator applies the clamp means to press and hold the two edges formed by the slit together in a sealed relation throughout their length, so that the seal device becomes an integral component again.

When the seal device is split and fitted to an elongate member extending through a roof, as above described, the clamped rib is located so as to be on the down side of the roof with respect to the elongate member, thereby reducing the risk of leakage of water through the reclosed slit. Nevertheless, the clamp means as provided to hold the two edges of the slit together in sealed relation is designed to be completely effective against the leakage of water therethrough.

The seal device as above described is constructed with the sleeve being of tubular form, preferably tapered, and with the base member in the form of an annular flange. In that form the sleeve and base member must be slit adjacent to the rib when the seal device is to be fitted in a situation where the sleeve may not be passed over an end of the elongate member. It is to be understood that the seal device may be initially constructed with the sleeve and base member already slit.

In an alternative construction, the sleeve and base member may be produced in a generally flat form of segmental shape, having the rib extending along one radial edge and the clamp means along the other radial edge. In subsequent use the two radial edges of the flat segmental shape are brought together and clamped to abut along the length of said edges, thereby forming a conical shape. The larger end of the conical shape forms the base member and the smaller end provides an aperture to receive the elongate member in sealing engagement.

This, as produced, flat form of the seal device substantially reduces manufacturing costs as the segmental shape can be produced in a relatively shallow die mould. It also reduces packaging, storage and transportation costs. When produced in this flat form and then rolled into the conical shape, the base member or flange is initially a continuation of the conical form of the sleeve and is then deformed at installation to extend outwardly from the lower end of the sleeve to provide the flange to be secured by suitable fastening devices to the sheet or structure surrounding the elongate member.

A separate annular ring of metal or other suitable non-resilient manually deformable material may be provided to be placed on the base member about the sleeve during installation. The fastening devices such as screws, rivets, or bolts, are fitting through suitable apertures provided in, or made during installation in, the ring, base member and sheet or structure so the base member is clamped between the ring and sheet or structure to establish an effective seal.

Conveniently, the base member which is made of a resilient material, has along at least part of it's length a member or members of non-resilient manually deformable material, such as a soft metal, attached thereto and may be adapted to be manually stretched in at least one direction and when so stretched to be capable of maintaining that portion of resilient material to which it is attached, correspondingly stretched.

Preferably the adaption of the manually deformable member to be stretched in the one direction is such that compressing of the manually deformable member may also be effected. In particular the adaption of the member may be such that it may be stretched along one edge and compressed along the opposite edge. This enables a portion of the member to be manually deformed in the plane thereof into an arcuate or curved form. The member or members are also manually deformable in the direction normal to the plane thereof so that it may be contoured along its length. This contouring of the member may be effected independently or in combination with stretching or compressing of the member.

Conveniently, the non-resilient manually deformable member is provided with a plurality of interruption along at least one edge, that edge extending substantially in said direction of desired stretch, whereby the member is stretched by increasing the width of the interruption at least along part of the length of the member. Preferably, interruptions are provided along each of two opposite edges of the member with alternate interruption extending from opposite edges of the member. The interruptions are preferably in the form of slits or slots that extend from the opposite edges more than half the width of the member, or at least overlap one another in the direction of the width of the member, conventiently in the longitudinal central region of the member.

The non-resilient manually deformable member may be attached to the base member by bonding to one face of the resilient material, either in a superimposed or inlaid relation having one face of the member exposed. Alternatively, the deformable member may be embedded in the resilient material of the base member. When the deformable member is embedded in the base member it is preferably that at least one face thereof be bonded to the resilient material of the base member.

In a construction wherein the seal device is manufactured in the flat form of segmental shape as above referred to, the member of deformable material will reduce in effective diameter as the radial edges of the segmental shape are brought together and clamped to form the conical sleeve and base flange. The member of deformable material is therefore provided with the slots or slits as above described to thus give the member the degree of extensibility and compressability in the circumferential direction to permit the required reshaping of the base flange into a completed annulas, extending generally outwardly from the larger end of the conical sleeve.

The manually deformable member may be a strip of metal, such as aluminum, with slots, or slits extending in from one or both longitudinal edges of the strip. The degree of stretch that the member may achieve without failure is increased with the length and number of the slots, or slits in the member.

One practical arrangement of the invention will now be described with reference to the accompanying drawings, which depict the invention applied to a sealing device of the type generally disclosed in the Australian Patent No. 514247.

Figure 1:
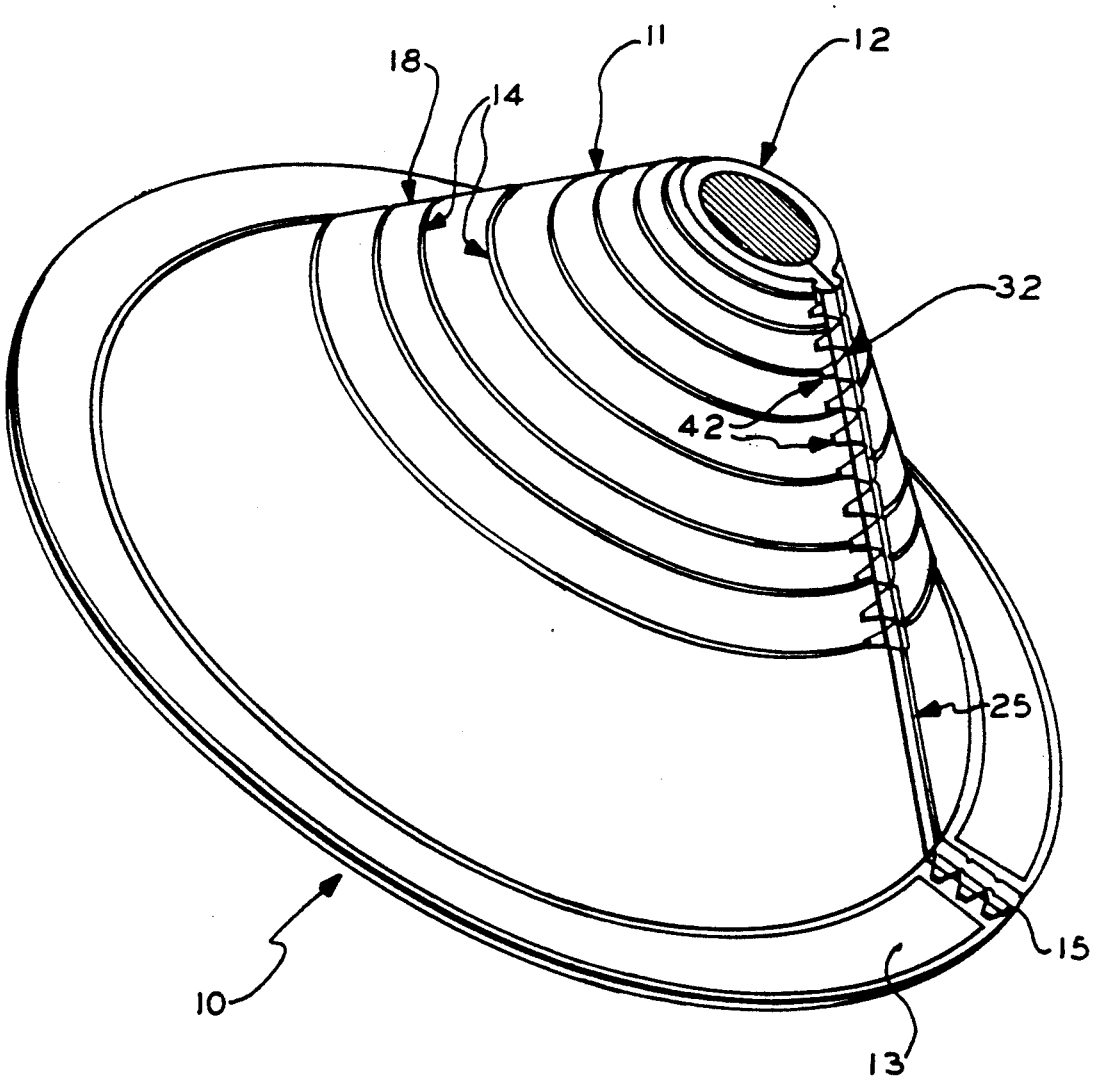
FIG. 1 is a perspective view from above of the seal device in accordance with the present invention.

The seal device as illustrated in FIG. 1 comprises an annular base flange 10 of resilient readily deformable material, such as natural or synthetic rubber, having an integral sleeve 11 of the same material extending from the upper face of the base flange. The sleeve 11 has a tapered portion 18 tapering toward the upper open end 12. The wall of the sleeve 11 is sufficiently flexible to accommodate misalignment of the upper end 12 relative to the other parts of the seal device, as may be necessary in normal use.

The smaller upper end 12 of the sleeve 11 is normally open and of a diameter to require enlargement thereof by stretching to fit a particular sized elongate member. As a result of the stretching the sleeve establishes a sealing contact with the elongate member.

Spaced along the tapered portion 18 are a plurality of external circumferential ridges 14 denoting where the sleeve may be cut off to suit larger elongate members of different diameters. The ridges also provide a reinforcement about the edge of the open end of the sleeve so formed.

As seen in part in FIG. 1, a rib 25 is provided down the external surface of the sleeve member 11 extending from the top edge thereof to the bottom of the sleeve member and then horizontally across the upper surface of the base flange 10 to the outer edge thereof. Although not shown in the drawings, it is preferable for the area at the junction of the sleeve 11 with the flange 10 through which the rib 25 passes, to be provided with a generous fillet rather than the relatively sharp corner normally provided at this junction.

The ring 13 is bonded to the upper face of the base flange 10 and is of a non-resilient manually deformable nature so that it may hold the base flange in a contoured form if desired. The ring 13 is split at 15 to provide for the rib 25 and clamp strip 32.

Figure 2:
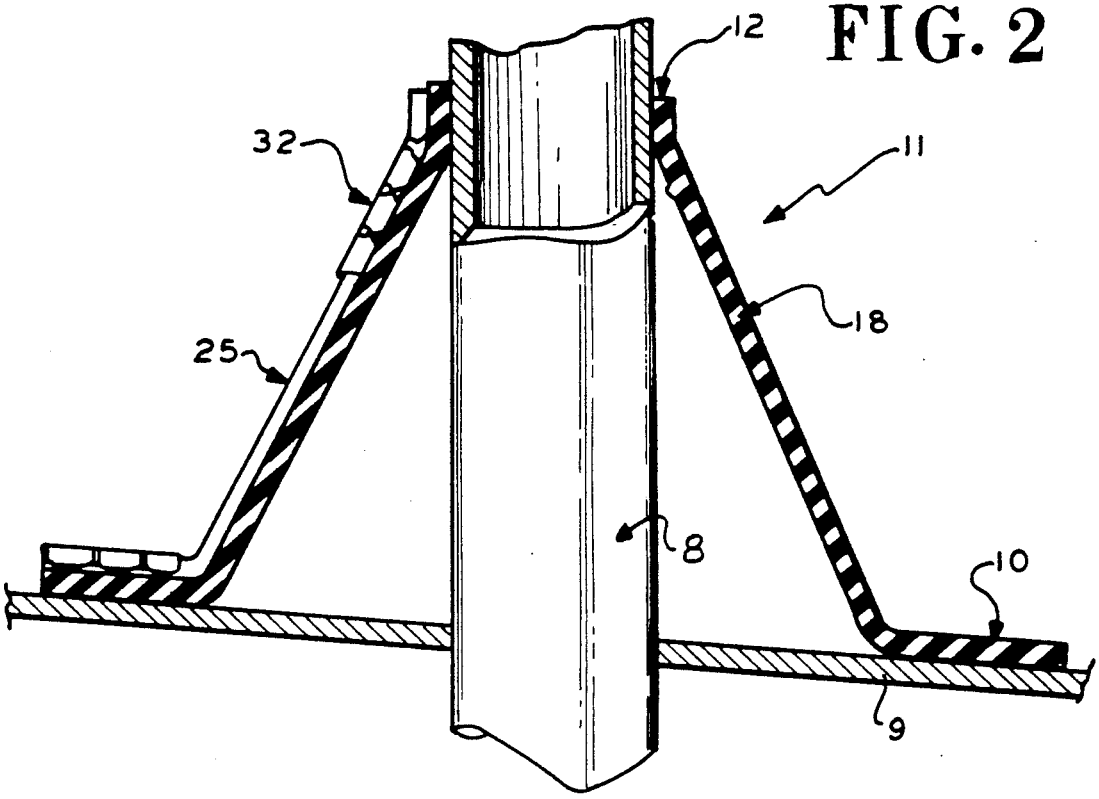
FIG. 2 is a vertical section through the sealing device shown in FIG. 1 when assembled to an elongated tubular member.

Adjacent to the ribs 25 is a clamp strip 32 bonded to or embedded in the rubber of the sleeve and base flange, and is adapted to co-operate with the rib 25 to form a sealed closure of a slit in the sleeve and flange as hereinafter described. In FIGS. 1 and 2 a mid-section of the clamp strip 32 is broken away to show the rib 25 therebeneath.

Figure 3:
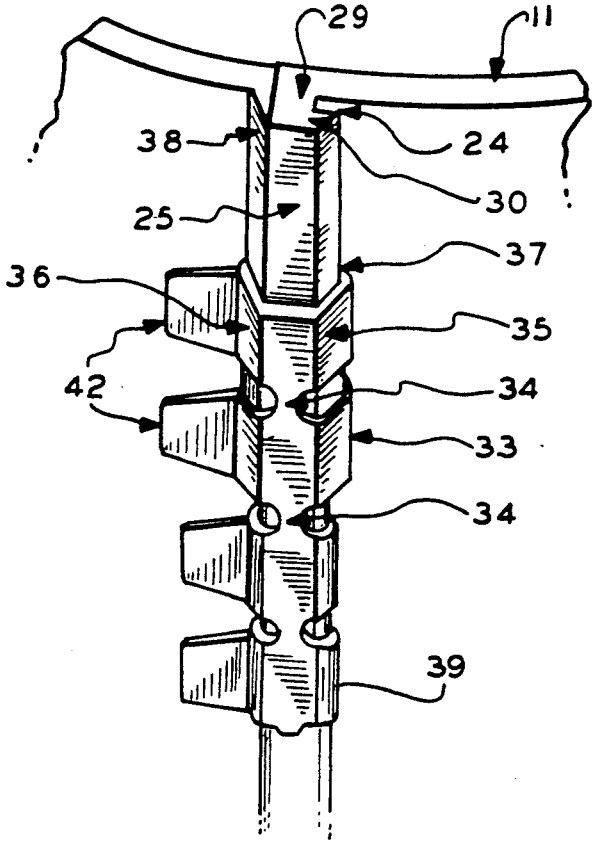
FIG. 3 is a fragmentary view of a portion of the sleeve member of the seal device with the rib and clamp means of the present invention incorporated thereon.

Also, as can be seen in FIG. 3, the rib 25 is provided with a shoulder 24 dividing the rib into a neck part 29 and head part 30. The shoulder 24 is preferably continuous throughout the length of the rib 25, but may be interrupted at selected locations along the length of the rib without departing from the effectiveness of the invention.

In the form as illustrated, the clamp strip 32 is made up of a series of U-shaped clamp elements 33 interconnected in a side by side relation by web elements 34. The clamp elements 33, in their initial state, have the arms 35 and 36 of the U outwardly directed from the base with the free ends 37 of arms 35 inwardly turned. The clamp elements in this configuration are shown in the top two elements in FIG. 3. When the arms 35 and 36 of the U-shaped clamp elements 33 are so spread, the head portion 30 of the rib 25 may be received between the arms 35 and 36 and the end portions 37 of the arms 36 may be seated in the neck part 29 at the base of the rib 25 beneath the shoulder 24.

The U-shaped clamp elements 33 of the clamp strip 32 each have a lateral extension at one side forming a plurality of fingers 42 that are secured to the sleeve 11 and base flange 10 to effect securement of the clamp strip 32 thereto. The fingers may be bonded to the external face of the sleeve and base flange, as shown in FIGS. 1 and 3, or embedded therein with or without bonding. The provision of a series of fingers rather than a continuous strip retains the flexibility of the clamp strip 32 arising from the clamp elements being interconnected by the web elements 34 only. It is also preferred to have a strip of rubber, such as the strip 38 integral with the wall of the sleeve, located within the clamp strip 32 along the side attached by the fingers to the sleeve. When the rib 25 is embraced by the clamp elements, and the elements are closed to grip the rib, the rib 25 will be pressed against that strip of rubber to improve the quality of seal therebetween.

The clamp strip 32 of the clamp element 33 may be conveniently formed from a one piece metal strip with the web elements 34 providing the required flexibility between adjoining clamp elements so that the clamp strip may closely follow the contour of the sleeve member and base flange when they are in the working fitted condition to the elongated member and the roof sheet. In an alternative construction, the clamp element 33 may be made as individual components secured to the sleeve and base flange and/or fitted to a backing strip of suitable flexible material, such as a resilient plastic material, which may be moulded or extruded on to the respective clamp elements to secure them in the form of a strip.

It will be appreciated from the preceding description that the provision of the rib 25 and clamp strip 32 does not interfere with the original construction of the seal device, and accordingly, the seal device may be used in the manner similar to the prior art and as described in the prior Australian Patent No. 514247 previously referred to. In that previous mode of use, the seal device is threaded onto the elongated member from one end thereof, and thus it was necessary for the elongated member to be free of any protrusions or attachments, that would prevent the seal device being moved from the end thereof to the desired location adjacent the roof or the surface through which the elongated member extended.

However, when it is desired to fit the seal device to an elongated member 8 already in position, extending through a roof or like cladding member 9 and being coupled to other components or equipment to prevent the fitment of the seal device via the end of the elongated member, then the operator may split the sleeve and base flange between the rib 25 and clamp strip 32 for the total length of the rib 25 thereof. In that situation the sleeve member 11 and flange 10 are severed completely along one side so that the seal device may be opened out and placed about the elongated member without the necessity of threading the elongated member through the sleeve member and flange. After the seal device has been so assembled to the elongated member the edges of the slit are brought together and the clamp strip 32 is located to embrace the rib 25 to re-establish continuity of the wall of the sleeve member 11 and of the base flange 10.

The operator may then close the clamp elements by deflecting the arms 35 and 36 inwardly by the use of a pair of pliers or a like hand tool. This will bring the arms 35 and 36 into a generally parallel relation as shown at 39 in FIG. 3, thereby compressing the edges of the slit tightly to form a seal. It will be appreciated that when the arms of the clamp elements are so squeezed together, the end portion 37 of the arms 35 will pinch the neck portion 29 of the rib and be firmly seated beneath the head portion 30. These various interactions between the clamp elements and the rib ensure that the clamp element cannot be accidentally dislodged from the rib 25, and the rib 25 is firmly compressed to form an effective weather tight seal therebetween.

In the above described construction the sleeve 11 and base flange 10 are slit adjacent to the rib 25 when the seal device is to be installed, however, it is to be understood that the seal device may be manufactured with the sleeve and base flange already split, with the clamp strip integral therewith and extending along one edge of the slit and the rib extending along the other edge of the slit.

Figure 4:
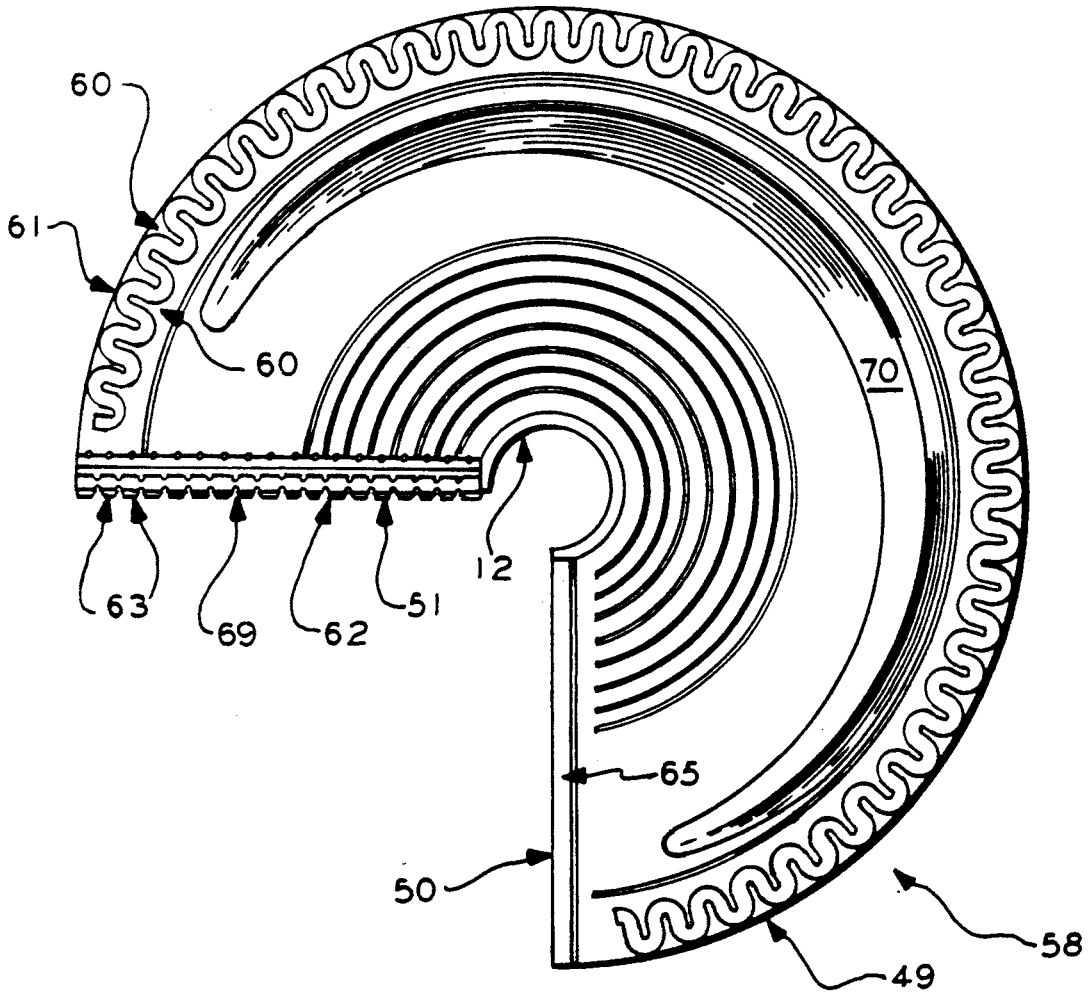
FIG. 4 is a view of an alternative construction of the seal device in the as manufactured form.

In a further alternative construction, as illustrated in FIG. 4 of the drawings, the seal device may be manufactured in the form of a generally flat rubber moulding of segmental shape. In the form illustrated the segment is approximately 270° of arc so the two radial edges 50 and 51 have an included angle of about 90°. A rib 64 and clamp strip 62, generally constructed as previously described, are provided along the edges 50 and 51 in a like manner to that previously described.

Along the perimetal area 49 of the flat moulding is a metal strip 58 secured to the rubber moulding. The strip 58 may be bonded to the surface of the moulding, inlaid therein, or embedded therein with or without bonding between the metal and rubber. The strip 58 has slots 60 extending in from each of the longitudinal edges 61 of the strip. The junction of the slots with the edge of the strip are radiused to reduce the risk of the corners piercing the rubber. The metal strip may be stretched in the longitudinal direction by applying tension to the strip to open out, that is widen, the slots 60. This stretching of the strip is a non-resilient stretch and will effect a similar stretching of the rubber of the moulding in the area of the metal strip,. The functioning of the slotted metal strip has been further described earlier in this specification.

Figure 5:
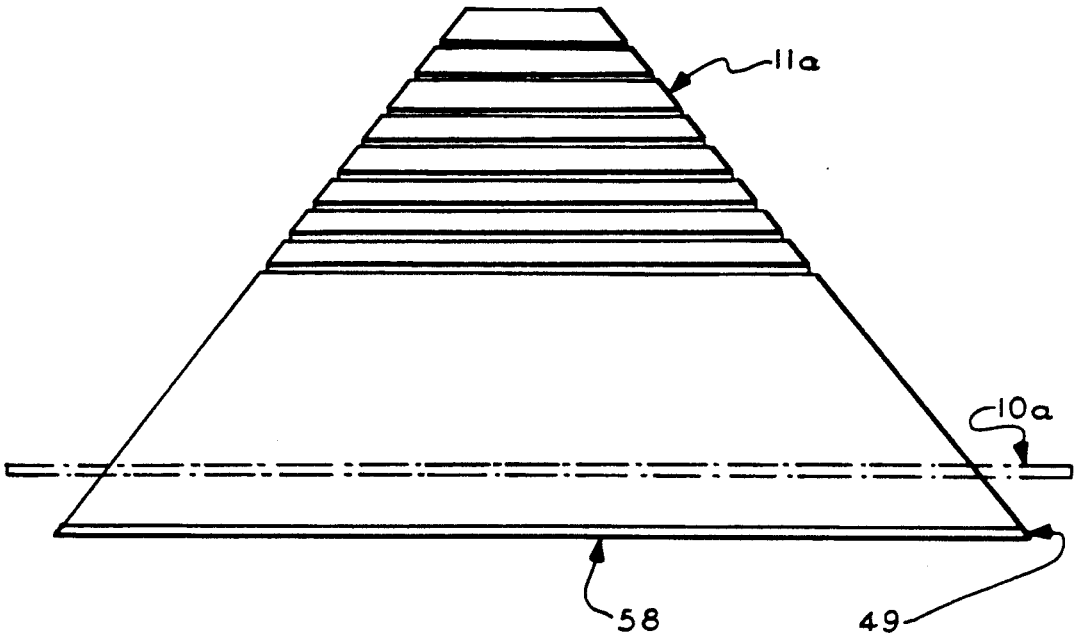
FIG. 5 is a diagrammatic view of the seal device shown in FIG. 4 in the as used form.

When the flat moulded seal device is to be used the two radial edges 50 and 51 are brought into abutting relation about the elongate member, and the clamp strip 62 and rib 65, are operatively interengaged to form a sealed joint between the edges 50 and 51. There is thus formed a generally conical shaped sleeve 11*a* with the perimetal area 49, carrying the strip metal 58, generally co-extensive with the sleeve 11*a* as shown in FIG. 5. The perimetal area 49 may then be increased in length at the lower edge by stretching the metal strip 58 to increase the width of the slots 60 and thereby increase the circumferential length of the lower edge of the perimetal area. The ability to increase the length in a non-resilient manner enables the perimetal area to be formed into an annular flange 10*a* projecting outwardly around the lower large end of the sleeve 11*a* and co-axial therewith, as shown in broken outline in FIG. 5.

Figure 6:
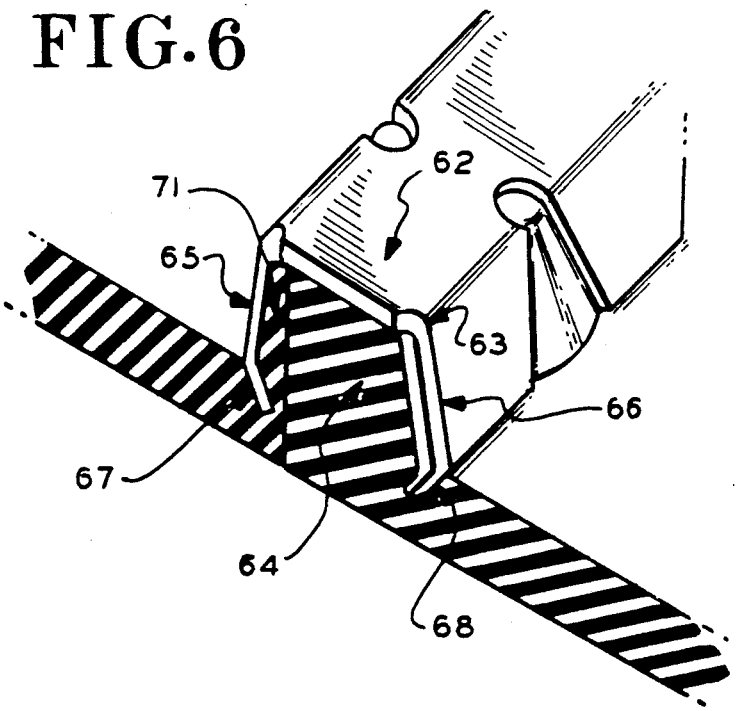
FIG. 6 is a fragmentary view of portion of the seal device shown in FIG. 4 with the clamp strip in the assembled state.

In a preferred construction, the clamp strip is as shown in FIG. 6 comprising a plurality of clamp elements 63 of U shape, interconnected by web sections 69. The respective arms 65 and 66 of each clamp element are of the same construction but of opposite hand, with respective inwardly directed end portions 67 and 68. During moulding of the sleeve and base flange of either of the previously described embodiments of the sealing device the inwardly directed end positions 67 of the arms 65 are embedded in the rubber of the sleeve and base flange moulding. As a result of this embedding of the end portion of arms 65 in the moulding the clamp strip is securely attached to the moulding, with the moulding extending through the gaps formed between adjacent clamp element arms 65. Also a continuous strip 71 of rubber is provided within the clamp elements adjacent the arms 65.

The securement of the clamp strip to the sleeve and flange as above described is primarily for retaining them in assembly prior to installation. Upon installation, the closing of the clamp elements about the rib 25 to clamp the two edges of the sleeve and flange together will effect lasting securement of the clamp strip to the moulding forming the sleeve and base flange.

In each of the above described constructions of the seal device, when being installed the base flange 10 is manually deformed to closely follow the contour of the surface of the cladding sheet 9 to which it is being fitted. The base flange is secured to cladding sheet 9 through which the elongated member 8 extends by screws, bolts or rivets that pass through the base flange and cladding sheet. Where the slotted form of the metal strip is incorporated in the base flange, the screws, bolts or rivets are passed through a part of the metal strip or through a washer or the like. The installation of the screws, bolts or rivets achieves a clamping or compression of the resilient material of the base flange between the metal strip and the cladding sheet to provide an effective weather tight seal therebetween. If desired, a sealant paste or the like may be used between the cladding sheet and base flange.

As previously referred to, the sealing device is preferably installed so the side thereof on which the rib and clamp means are provided is located on the lower side or downstream side with respect to the water flow over the roof or cladding sheet. This results in the slit adjacent the rib facing downstream with respect to the water flow and therefore reduces the risk ofleakage due to incorrect installation or damage subsequent to installation.

In the embodiment illustrated in FIGS. 4 and 5, a fold or pleat 70 is formed at the junction of the sleeve 11*a* and base flange 10*a* during moulding of the seal device. The fold 70 is a maximum height at the mid-portion of the length off the fold and progressively decrease toward each end thereof. As seen in FIG. 4 the fold 70 creases a short distance from the respective radial edges 50 and 51. This results in an opening being left on either side of the ridge formed by the clamp elements and the rib assembly of the seal device when installed. Accordingly, as this ridge is on the downstream of the installed seal device, water collecting between the fold 70 and sleeve 11*a* may freely drain therefrom around the respective ends of the fold.

This form of fold may also be incorporated in the seal device as described with reference to FIG. 1. A further advantage of the fold 70 is that it provides an increase in the flexibility between the sleeve and base flange to accommodate relative misalignment and movement therebetween.

I claim:

1. A seal device for providing a weather seal between an elongate member and a cladding sheet through which the elongate member extends, the seal device comprising an apertured base member of resilient deformable material to be located in use in superimposed relation to the sheet with the elongate member extending through the aperture, a sleeve of resilient deformable material integral with the base member and projecting from one side thereof, the sleeve member encompassing said aperture in the base member so that in use the elongate member also extends through the sleeve member, a rib formed integral with the sleeve and base member projecting outwardly from the external surface thereof, said rib extending generally down the length of the sleeve and across the base member to the outer edge thereof, whereby in use the wall of the sleeve and base member is slit adjacent to and for the full length of the rib to permit opening of the sleeve and base member for fitment about the elongated member, and clamp means secured to the sleeve and to the base member extending parallel to and for the length of the rib so the slit can be made between the rib and the clamp means, the clamp means comprises a series of clips interconnected in a strip form, the interconnection between the clips being flexible at least in the longitudinal direction, each clip having a portion to receive and embrace the rib and is non-resiliently deformable to grip the rib to thereby sealably close the slit to secure the sleeve and base member around the elongated member, wherein the sleeve and base member are molded integral in a generally planar form of segmental shape, having two substantially radial edges, wherein each of said clips has a lateral extension at one side forming a finger secured to said sleeve and said base flange to effect securement of said clamp strip thereto, said rib extending along one said radial edge and the clamp means extending along the other said radial edge, said sleeve having an upper edge portion having a plurality of radially-spaced circumferential guide ridges for ease of cutting the edge portion to tightly fit the elongate member.

2. The weather seal as defined in claim 1, wherein a perimetal margin portion extending between said radial edges and has bonded to one face thereof a continuous metal strip adapted to be non-resiliently stretchable in the circumferential direction, whereby said strip will be stretched when the perimetal margin portion is deformed outwardly to form the base member and thereby retain the base member in that disposition.

3. The weather seal as defined in claim 1, wherein the strip of metal has circumferentially spaced slots formed therein extending from at least one edge thereof in a direction across the direction of stretch.

4. The weather seal as defined in claim 3, wherein the slots in the strip of metal extend from opposite edges of the strip.

5. The weather seal as defined in claim 4, wherein the slots in the strip of metal alternately extend from opposite edges of the strip.

6. The weather seal as defined in claim 5, wherein the annular member of non-resilient deformable metal is located about the sleeve and bonded in face to face relation to the base member and is adopted to be manually stretchable in the circumferential direction.

7. The weather seal as defined in claim 6, wherein the annular member has circumferentially spaced slots formed therein extending from an edge thereof in a direction across the direction of stretch.

8. A seal device for providing a weather seal between an elongate member and a cladding of a building sheet through which the elongate member extends, the seal device comprising an apertured base member of manually deformable resilient material to be located in use in superimposed relation to the sheet with the elongate member extending through the aperture, a sleeve of manually deformable resilient material integral with the base member and projecting from one side thereof, the sleeve member encompassing said aperture in the base member so that in use the elongate member also extends through the sleeve member, a rib formed integral with the sleeve and base member projecting outwardly from the external surface thereof, said rib extending generally down the length of the sleeve and across the base member to the outer edge thereof, whereby in use upon splitting the wall of the sleeve and base members adjacent to and for the full length of the rib permits opening of the sleeve and base member for fitment about the elongate member, and clamp means secured integrally to the sleeve and to the base member and extending parallel to and for the length of the rib so that upon splitting the slit is made between the rib and the clamp means, the clamp means comprises a series of clips interconnected in a strip form, the interconnection between the clips being flexible at least in the longitudinal direction, each clip having a portion to receive and embrace the rib and is non-resiliently deformable to grip the rib and thereby by the deformation alone sealably close the slit to secure the sleeve and base member around the elongate member, wherein each of said clips has a lateral extension at one side forming a finger secured to said sleeve and said base flange to effect securement of said clamp strip thereto, said rib having a neck portion for conforming the rib to the clamp means.

9. The weather seal as defined in claim 8, wherein each clip is of generally U shape cross-section and the clips are interconnected in spaced relation at the base of form a channel like strip, one arm of each U shape clip on the same side of each clip being secured to the sleeve or base member at a location so the slit can be made between the rib and arms of the clips secured to the sleeve and base member.

10. The weather seal as defined in claim 9, wherein each said one arm has an end portion thereof turned inwardly toward the other arm of that clip, said turned-in portion on each clip being embedded in the sleeve or base member.

11. The weather seal as defined in claim 10, wherein the sleeve and base member are moulded integral in a generally planar form of segmental shape, having two substantially radial edges, said rib extending along one said radial edge and the clamp means extending along the other said radial edge.

12. The weather seal as defined in claim 11, wherein the perimetal margin portion of said segmental shape extending between said radial edges forms and said base, has bonded to one face thereof a continuous metal strip adapted to be non-resiliently manually stretchable in the circumferential direction, whereby said strip will be stretched when the perimetal margin portion is deformed outwardly to form the base member and thereby retain the base member in that disposition.

13. The weather seal as defined in claim 12, wherein the strip of metal has circumferentially spaced slits formed therein extending from at least one edge thereof in a direction across the direction of stretch.

14. The weather seal as defined in claim 13, wherein the slits in the strip of metal extend from opposite edges of the strip.

15. The weather seal as defined in claim 14, wherein the slits in the strip of metal alternately extend from opposite edges of the strip.

16. The weather seal as defined in claim 8, wherein the sleeve and base member are formed with said slit therein located between and extending the length of said rib and clamp means.

17. The weather seal as defined in claim 8, wherein an annular member of non-resilient deformable metal is located about the sleeve and bonded in face to face relation to the base member whereby the base member will take-up and retain any contoured shape imparted to the annular member.

18. The weather seal as defined in any one of claims 8 to 10, wherein an annular member of non-resilient deformable metal is located about the sleeve and bonded in face to face relation to the base member and is adopted to be manually stretchable in the circumferential direction.

19. The weather seal as defined in claim 18, wherein the annular member has circumferentially spaced slot or slits formed therein extending from an edge thereof in a direction across the direction of stretch.

20. The weather seal as defined in claim 19, wherein the slots or slits in the annular member extend from opposite edges of the annular ember.

21. The weather seal as defined in claim 20 wherein the slits in the annular member alternately extend from opposite edges of the annular member.

* * * * *